US006516961B1

(12) United States Patent
Knecht et al.

(10) Patent No.: US 6,516,961 B1
(45) Date of Patent: Feb. 11, 2003

(54) RINGLIFT CRANE

(75) Inventors: Alexander Knecht, Zweibrücken (DE); Manfred Kretschmer, Hilden (DE); Michael Biermann, Zweibrücken (DE); Ralf Frankenberger, Kaiserslautern (DE)

(73) Assignee: Atecs Mannesmann AG, Düsseldorf (DE)

( * ) Notice: Subject to any disclaimer, the term of this patent is extended or adjusted under 35 U.S.C. 154(b) by 0 days.

(21) Appl. No.: 09/647,023

(22) PCT Filed: Mar. 25, 1999

(86) PCT No.: PCT/DE99/00955

§ 371 (c)(1),
(2), (4) Date: Sep. 26, 2000

(87) PCT Pub. No.: WO99/48793

PCT Pub. Date: Sep. 30, 1999

(30) Foreign Application Priority Data

Mar. 26, 1998 (DE) ..... 198 14 641
Mar. 24, 1999 (DE) ..... 199 14 195

(51) Int. Cl.[7] ..... B66C 23/78
(52) U.S. Cl. ..... 212/301; 212/196
(58) Field of Search ..... 212/301, 302, 212/303, 196

(56) References Cited

U.S. PATENT DOCUMENTS 4,195,740 A * 4/1980 Beduhn et al. ..... 212/301
4,394,911 A * 7/1983 Wittman et al. ..... 212/189
4,579,234 A * 4/1986 Delago et al. ..... 212/178

* cited by examiner

*Primary Examiner*—Thomas J. Brahan
(74) *Attorney, Agent, or Firm*—Cohen, Pontani, Lieberman & Pavane

(57) ABSTRACT

A ringlift crane having a ring which can be elevated, forms an annular track and has a plurality of segments which can be connected to one another, there being arranged within said ring an undercarriage which has an upper carriage, which is connected for slewing action to the undercarriage and has a plurality of hoisting winches. Two trusses which are spaced apart parallel to one another, are provided, in two mutually opposite end regions, with in each case one adapter and can be bolted to, and unbolted from, the upper carriage via crossmembers. The adapters are supported with rolling action on the annular track of the ring by rollers arranged in the end region of the adapters. For the purpose of setting different modes of operation of the crane, the trusses can be raised relative to the basic machine and connected in different ways to the crossmembers.

21 Claims, 13 Drawing Sheets

FIG. 8a
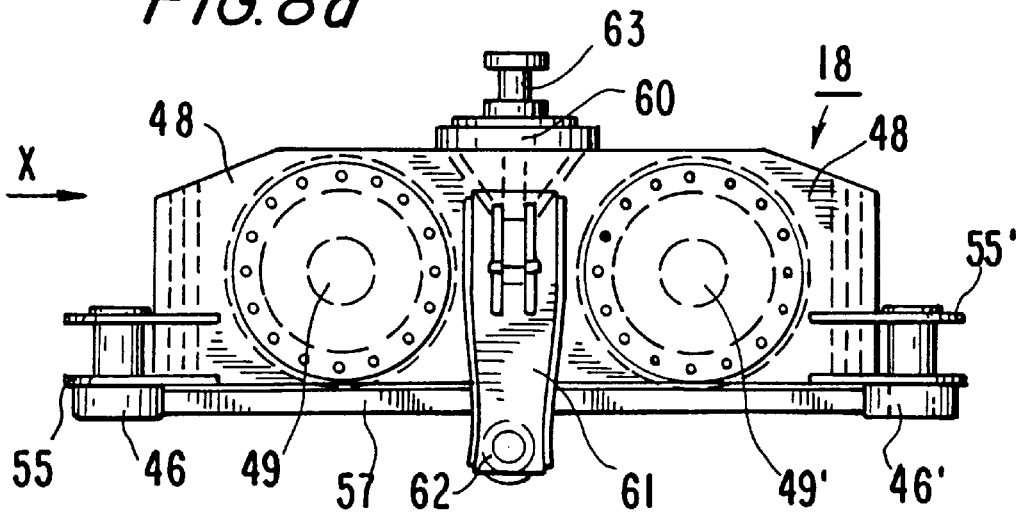
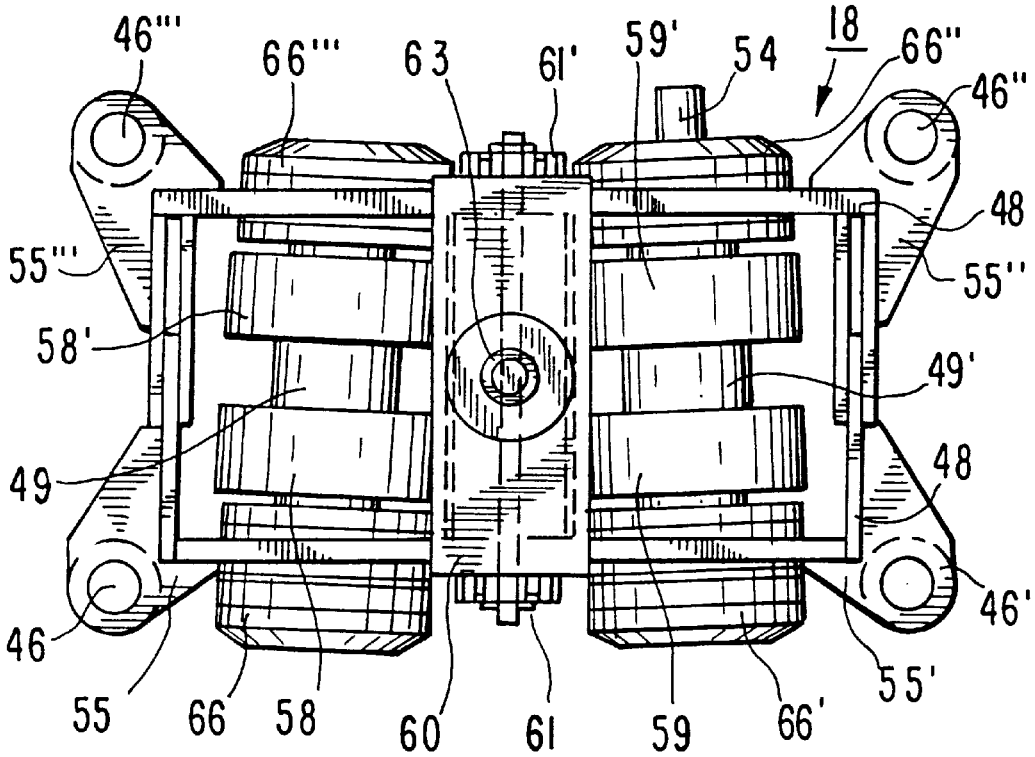
FIG. 8b

RINGLIFT CRANE

PRIORITY CLAIM

This is a U.S. national stage of application No. PCT/DE99/00955, filed on Mar. 25, 1999. Priority is claimed on that application and on the following application(s): Country: Germany, Application No.: 198 14 641.8, Filed: Mar. 26, 1998; Country: Germany, Application No.: 199 14 195.9, Filed: Mar. 24, 1999.

BACKGROUND OF THE INVENTION

1. Field of the Invention

The invention relates to a ringlift crane.

2. Discussion of the Prior Art

A known ringlift crane is described in the Mannesmann Demag Baumaschinen company brochure entitled "Ringlift Cranes" CC 2000 RL; CC 4000 RL, issue November 1982. This ringlift crane has a ring which can be elevated, forms an annular track and comprises a plurality of segments which can be connected to one another. Arranged within the ring is an undercarriage and an upper carriage, which is connected for slewing action thereto and has a plurality of hoisting winches. In the two end regions, the upper carriage is connected to in each case one adapter, and these adapters are supported with rolling action on the annular track of the ring by means of sets of rollers which are arranged on the adapters and are connected to one another via links. In this case, the center point of the ring and/or of the undercarriage forms the slewing axis. One adapter is designed for accommodating a counterweight and the other adapter is designed as a load-bearing element for a boom which can be articulated at the free end of the adapter. The slewing movement of the ringlift crane is produced by means of a toothed rim, which is arranged on the inside of the ring, and pinions which engage in the rim and are mounted via links. For the purpose of stabilizing the overall structure, the undercarriage is connected to different sections of the ring via reinforcing struts.

A comparable design is known from U.S. Pat. No. 4,103,783. This ringlift crane comprises a ring, which can be elevated and forms an annular track, and a structure within the ring with a kingpin and a platform which is provided with a sleeve for accommodating the kingpin. In the two end regions, the platform is connected to in each case one adapters. The adapters are supported with rolling action on the ring by means of sets of rollers arranged on the adapters. The center point of the ring forms the slewing axis for the platform. A plurality of hoisting winches are arranged on the platform and a counterweight is arranged on the rear adapter. A main boom and a mast (counter-boom) are articulated on the front adapter. The single-part ring is stiffened by struts which run within the ring in secant form. In each case one piston/cylinder unit is arranged at four points of the circumference, at the ends of two mutually parallel struts, it being possible for a supporting foot to be arranged at the free end of the piston/cylinder unit. By means of these four piston/cylinder units, it is possible for the ring to be raised together with the crane arranged thereon, with the result that a crawler-type vehicle or the like can be moved therebeneath. The crawler-type vehicle can be locked to the load-bearing element. Travel of the ringlift crane as a whole is possible in this way.

The disadvantage with the last-mentioned design is that the size of the ring diameter, and thus the maximum load which can be borne, is limited. Moreover, the way in which the ringlift crane is connected to the transporting unit is complicated. Furthermore, the non-divided ring requires a large amount of space during travel of the ringlift crane and, depending on the local conditions at the use location, this amount of space is not always available.

A ringlift crane of the generic type is known from U.S. Pat. No. 4,196,816. This ringlift crane comprises a ring which can be elevated, forms an annular track and has a plurality of segments which can be connected to one another, there being arranged within said ring an undercarriage which has an upper carriage, which is connected for slewing action to the undercarriage and has a plurality of hoisting winches, and two trusses which are spaced apart parallel to one another and are provided, in two mutually opposite end regions, with in each case one adapter and can be bolted to, and unbolted from, the upper carriage via crossmembers. The adapters are supported with rolling action on the annular track of the ring by means of rollers arranged on the adapters, it being the case that the center point of the ring and/or of the undercarriage forms the slewing axis. One adapter is designed for accommodating a counterweight and the other adapter is designed for accommodating a boom which may be articulated. A toothed rim is arranged for producing the slewing movement of the ringlift crane, the slewing movement thereof being transmitted to the two trusses. The undercarriage is connected to different sections of the ring via reinforcing struts.

The disadvantage here is that, during pivoting and traveling, the components of the crane are supported on the ring and thus on the undercarriage. On account of the power of the crawler-type vehicles being too low, first of all counterweight reductions have to be carried out for traveling and pivoting. Since the counterweight cannot be displaced, further dismantling operations (e.g. boom parts) are necessary for balancing out the crane. In order that the crane can pivot or travel, it has to be raised up on the ring and the supporting plates either have to be removed completely or all have to be raised upward individually.

SUMMARY OF THE INVENTION

The object of the invention is to provide a ringlift crane which can easily be pivoted and made to travel in a space-saving manner and without counterweight reductions and without parts being dismantled. Moreover, the intention is for it to be possible to use as many components as possible in a modular manner for different ringlift classes.

The invention proposes that, for the purpose of setting different modes of operation of the crane, the trusses can be raised relative to the basic machine and connected in different ways to the crossmembers with a force fit, it being the case that, in the starting position, the form-fitting connection between the trusses and the crossmembers has a predeterminable level of play. For the stewing movement a plurality of ring trolleys are provided which are of identical construction, have two axles and wheels fastened thereon and can be connected with a form fit, on the one hand, to the trusses and, on the other hand, to the ring or a ring segment. At least one axle of the ring trolleys arranged beneath the boom and/or beneath the counterweight can be driven. It is thus possible to dispense with the hitherto conventional toothed rim and the high-outlay pinion drive. In order to realize the force fitting connection between the truss and the crossmember, an upright bolt having a stop is arranged in each end region of each crossmember. If there are two crossmembers, this means four bolts. The stop, which preferably comprises a round plate, interacts with a bearing block which encloses the bolt and is fastened on the truss. The spacing between the top side of the crossmember and the plate of the bolt, on the one hand, and the spacing between the base plate of the bearing block and the stop of the bolt, on the other hand, can be partially or more or less completely filled by spacer plates which can be displaced on the top side of the crossmember. The spacer plates can be bolted and unbolted via carry-along pins.

Depending on the size of the ring, each truss comprises sections which are suitable for normal road transport and can be bolted to one another and unbolted from one another. Unlike the known prior art, the four piston/cylinder units, which are necessary for raising the overall structure, are arranged in the end region of the trusses. Preferably fastened on each end side of each truss is an angle piece, which, at its free end, can be connected to the piston/cylinder unit. As is known, a supporting foot can be arranged at the free end of the piston. The operation of raising the overall structure by means of the four piston/cylinder units allows the force fitting connection between the crossmembers and the two trusses. This easily ensures the capacity of the ringlift crane for pivoting and traveling.

The different ways of providing a force fitting connection between the trusses and the crossmembers on the upper carriage fulfill three functions:

Pivot locking

Since, with the high loads, the basic machine can no longer pivot straight away into another direction of travel, the proposed locking system is utilized as an auxiliary means. The basic crane and ring are raised with the aid of the piston/cylinder units fastened at the ends of the trusses, a force fitting connection having been produced beforehand between the crossmembers and the trusses by means of displaceable spacer plates, with the result that the crossmembers, and thus the upper carriage, are raised as well. With the aid of the slewing gear on the upper carriage, the undercarriage is then pivoted into the desired direction of travel together with the ring.

Travel locking

With this type of locking, the trusses and the ring are raised by means of the four piston/cylinder units fastened at the ends of the trusses and, following force fitting connection between the non-raised crossmembers and the trusses by means of push-in spacer plates, the undercarriage can travel in a straight line—to be precise forward and backward.

Operational locking

By virtue of the locking system, it is also possible to use the ring, the trusses and the basic machine as an additional counterweight during the operation of the crane. This cuts back, in some circumstances, on up to 10% of the counterweight and the associated transport.

Since the ring comprises, as is known, a plurality of segments which can be connected to one another, it is possible, in a space-saving manner, for a plurality of segments to be dismantled prior to the travel of the crane. Two mutually opposite segments can be locked to the trusses via the ring trolleys and can travel along with the crane. In this case, the tangential extent of the lockable segments corresponds at most to the widthwise extent of the counterweight.

In order for it to be possible for the maximum load to be increased further, it is proposed, furthermore, to allow the ring trolleys to be supported on two concentric rings, with the result that the Hertzian stress for the wheels which are in contact with the ring surface remains below the permissible maximum value. The total load is thus often divided in half between two rings. In order for it to be possible for the ring trolleys to be displaced in the circumferential direction of the two rings, in each case two mutually opposite trolleys are connected to one another via a connecting link. Two trolleys arranged on the inner ring and two trolleys arranged on the outer ring form a unit and form the minimum number of components for setting up a trolley. Such a unit and a further unit of the same type can be connected to one another via a bridge element. The trolleys are linked to one another by a plug-in connection. The maximum number of ring trolleys which can be arranged on a ring is equal to or smaller than the arc length of the individual ring segment divided by the length of the ring trolleys. The angle taken up by the ring segment is preferably 60 degrees. The ring trolleys are of identical construction and are suitable for a ring with a small diameter, for example, of 21 meters and for a ring with a large diameter, for example, of 32 meters. This is realized such that the angle enclosed by the intersecting center lines of the two axles is the average between the angle for the smallest ring diameter and the angle for the largest ring diameter. The resulting negative effects on the rolling behavior of the ring trolleys in the case of a ring diameter which differs from the average are consciously accepted. The different rolling path of the wheel rolling on the outer region of the ring in relation to the wheel rolling on the inner region is compensated for by a different diameter. In order, however, that the ring trolleys continue to be horizontal, the ring track is subdivided into an outer track and an inner track with a step located therebetween, of which the height corresponds to half the difference between the wheel diameters. The form-fitting connection between ring trolley and ring or ring segment takes place via supporting plates which are arranged on the ring trolley and, at the end, are provided with a hook roller. The hook rollers engage beneath the top flange of the ring and thus limit a raising-up movement of the ring trolleys.

The center-of-gravity position of the ringlift crane is determined, inter alia, quite basically by the positioning of the counterweight in relation to the basic machine. In order to change this center-of-gravity position, it is thus proposed to arrange counterweight trolleys beneath the platform for the counterweight, it being possible for the wheels of the counterweight trolleys to roll on the top side of the trusses. In the same way, it is also proposed to arrange at that end of the two trusses which is located in the region of the counterweight an extension of the trusses that extends beyond the ring. The two measures have the following advantages: the counterweight can be displaced by means of the counterweight trolleys from the normal operating position in the direction of the slewing center. This optimizes the center of gravity for the travel of the ringlift crane on site. During travel of the counterweight along the extension beyond the ring, the following advantages are produced: with the same counterweight, a larger counterweight moment is produced, and this can be utilized for a higher load-bearing capacity. With the same counterweight moment, the counterweight can be reduced and the transportation of counterweight elements is reduced to the same extent.

The advantage of the proposed ringlift crane can be seen in that, despite a large increase in the load moments which can be borne, the Hertzian stress in the wheel surface annular track contact region remains beneath the permissible values and, without the actual crane being dismantled, the ringlift crane remains in a state in which it can travel easily, and the amount of space required for this travel is no larger than the widthwise extent of the counterweight.

Furthermore, in the proposed design, importance has been placed on the ringlift crane being of modular construction and on as many standardized components being used as possible. This begins with the undercarriage and the upper carriage, which are constituent parts of a standard crane, and is continued via the boom used and the hoisting winches as well as the crane cab. The boom may be designed as a single boom or as a so-called double boom. The last-mentioned structure has the advantage that the individual elements of the lower-crane-class double boom can be transported more easily, and can transmit a higher load moment, than the single boom used from a higher crane class. The trusses, which comprise a plurality of sections, can be used for a single ring and for a double ring. The ring trolleys are standardized and, depending on the load which is to be transmitted, the number of ring trolleys is increased or reduced and correspondingly linked to one another. In order to simplify the assembling and dismantling operations, wherever possible, use is made of plug-in connections, with the result that individual components can be raised and plugged in by means of an auxiliary crane.

BRIEF DESCRIPTION OF THE DRAWINGS

The ringlift crane designed according to the invention will be explained in more detail with reference to an exemplary embodiment in the drawing, in which:

FIGS. 4 and 5 show the basic operating steps for making the ringlift crane travel;

FIGS. 8*a,b* show the front view and plan view of a ring trolley;

DETAILED DESCRIPTION OF THE PREFERRED EMBODIMENTS

Figure 1:
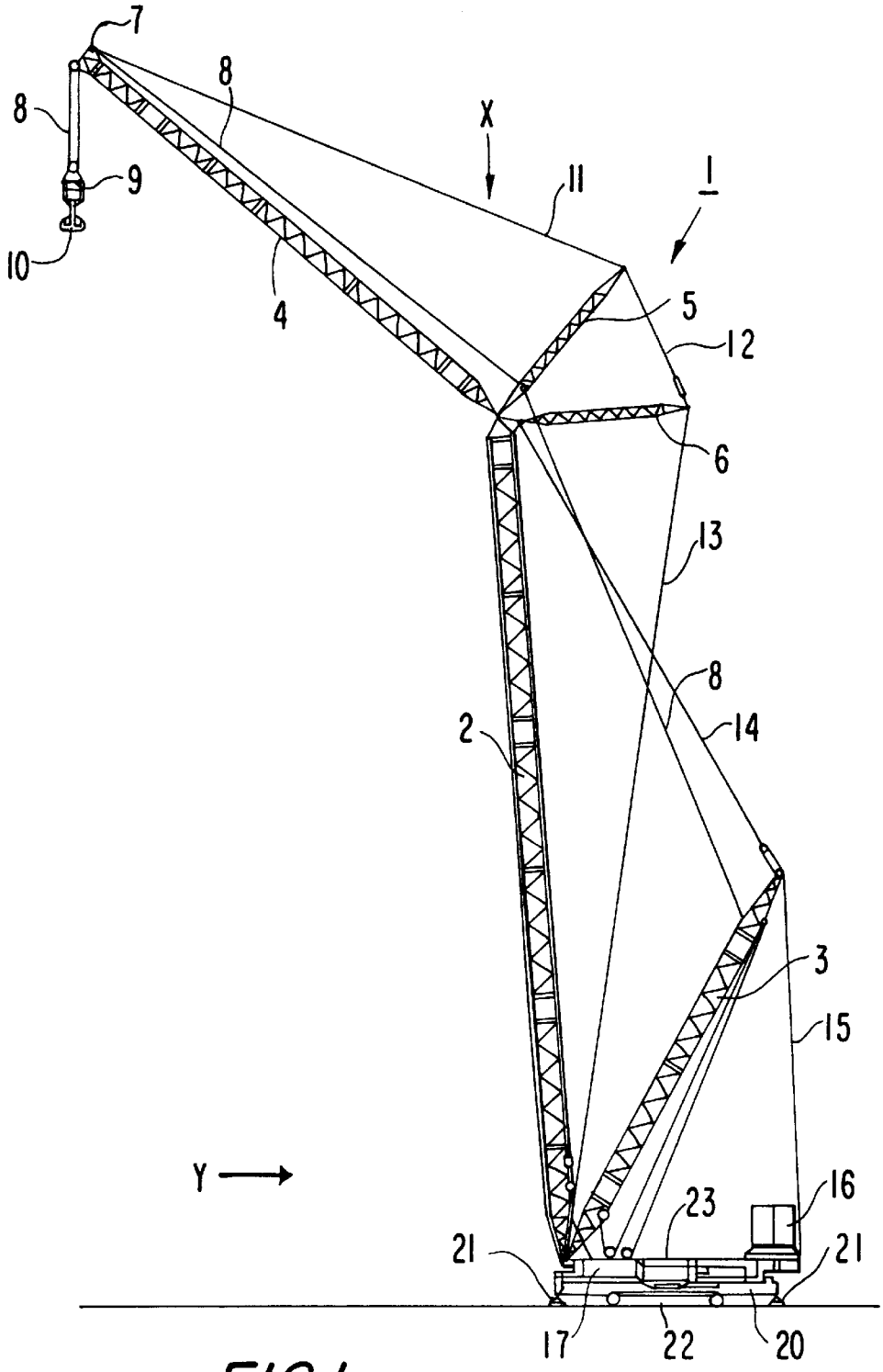
FIG. 1 shows a side view of a ringlift crane designed according to the invention.
Figure 2:
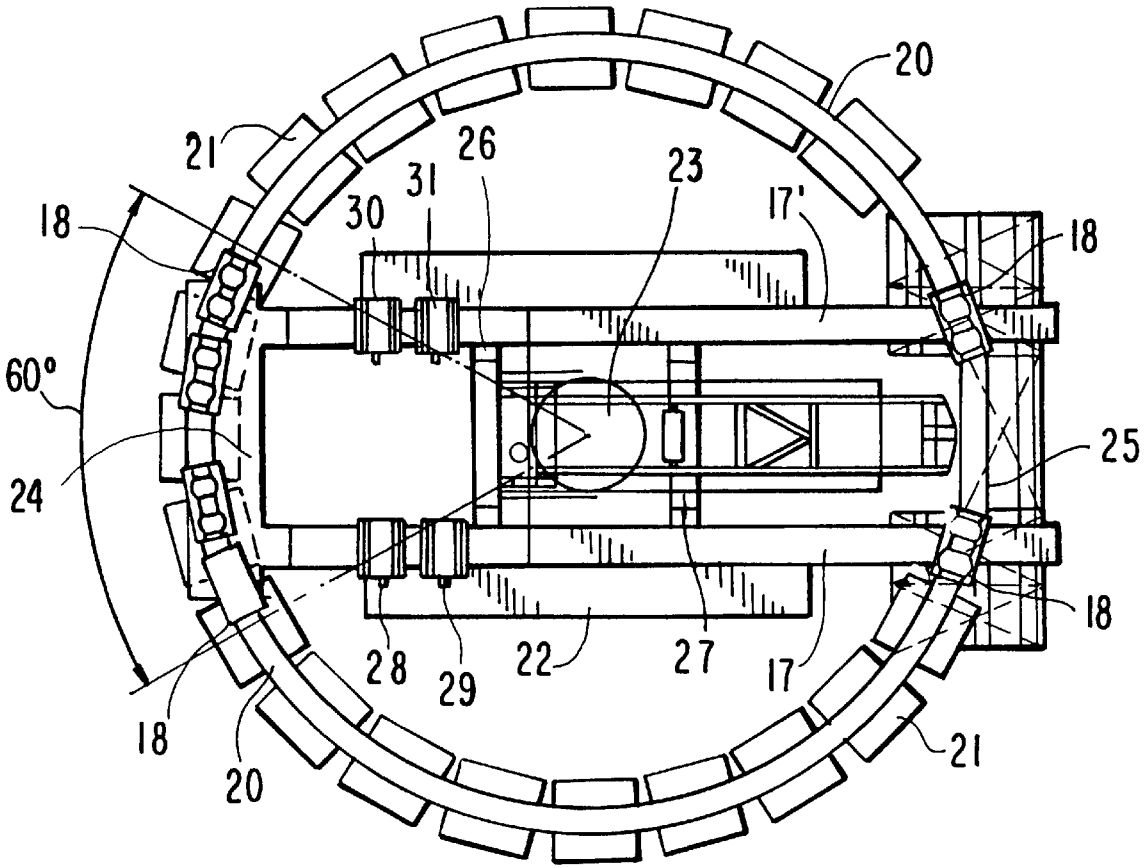
FIG. 2 shows a view in the direction X in FIG. 1, the crane superstructures being omitted.
Figure 3:
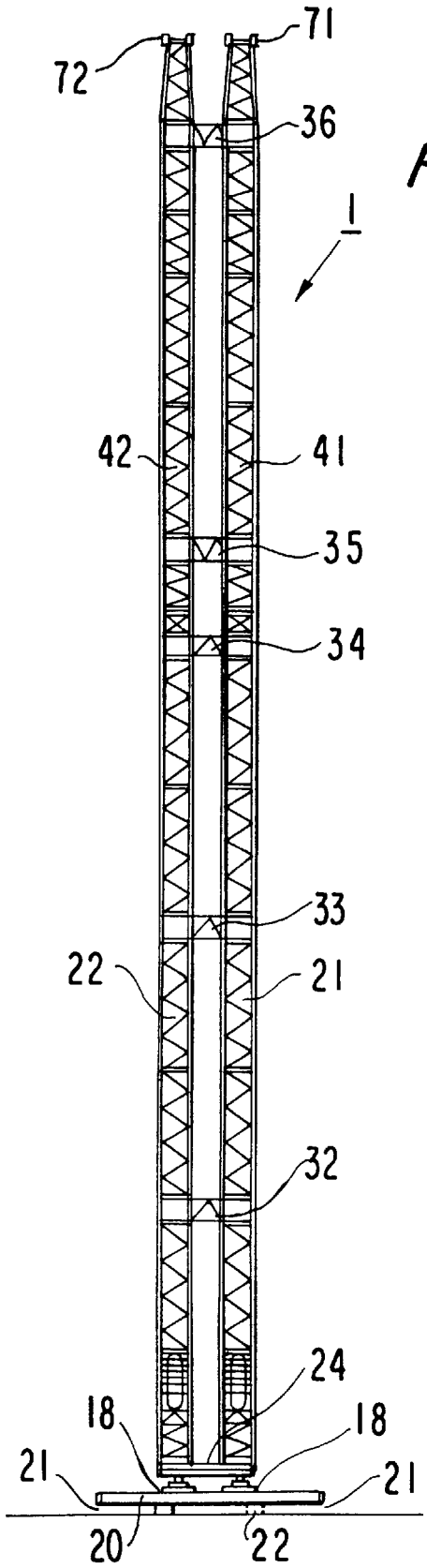
FIG. 3 shows a view in the direction Y in FIG. 1, with a double boom.

A ringlift crane 1 designed according to the invention is illustrated in a side view and in two views in directions X and Y in FIGS. 1–3. In this exemplary embodiment, the ringlift crane comprises a main boom 2, a mast 3, an auxiliary boom 4 and two luffing supports 5, 6. Arranged at the top of the auxiliary boom 4 is a top roller 7 over which the hoist cable 8 runs. A double hook 10 is arranged rotatably on a bottom block 9 hanging from the hoist cable 8. The top luffing support 5 is connected to the top of the auxiliary boom 4 via a fixed stay cable 11 and to the second luffing support 6 via a changeable stay cable 12. The bottom luffing support 6 is connected to the foot region of the main boom 2, in turn, via a fixed stay cable 13. The mast 3 is connected to the top of the main boom 2 via a changeable stay cable 14 and to the ends of two mutually parallel trusses 17, 17' via a fixed stay cable 15 (FIG. 2), said trusses forming the load-bearing element for the crane superstructures and the counterweight 16, and the two end regions being designed as adapters 24, 25. The main boom 2 and the mast 3 are fastened in an articulated manner on the front adapter 24, and the counterweight 16 rests on the rear adapter 25. The two adapters 24, 25 are supported, via ring trolleys 18 which are indicated here (see FIG. 8), on a ring 20 which forms an annular track and can be elevated via supports 21. The core element of the ringlift crane 1 forms a standardized undercarriage, in this case in the form of a crawler-type vehicle 22, and a standardized upper carriage 23, which is arranged for slewing action on the undercarriage. Provided in the region of the upper carriage 23 are two crossmembers 26, 27 which serve for making it possible for the trusses 17, 17' to be locked to the upper carriage 23 in different ways.

The trusses 17, 17' also serve, as can be seen in FIG. 2, for accommodating the main hoisting winches 28–31. The trusses 17, 17' form, together with the adapters 24, 25 and the crossmembers 26, 27, a rigid frame structure which is capable of bearing corresponding loads. In order that the loads resting in the two end regions of the trusses 17, 17' can be distributed as uniformly as possible to the ring 20, a plurality of ring trolleys 18 are arranged in the front end region. In this exemplary embodiment, there are four ring trolleys 18. In the rear end region, where the loads are smaller, half the number of ring trolleys 18 is sufficient. In general, the number of ring trolleys 18 with the wheels fastened thereon is related to the maximum permissible Hertzian stress in the region where the wheels of the ring trolleys 18 are in contact with the annular track of the ring 20.

FIG. 3 shows a view in the direction Y from FIG. 1. This illustration shows that it is possible for alternatively a single boom or a double boom to be arranged on the ringlift crane 1 designed according to the invention. Double boom is understood to mean an arrangement in which two identical lower-crane-class booms are positioned one beside the other and connected to one another by universal connectors 32–34 for the main boom 2.1, 2.2 and universal connectors 35, 36 for the auxiliary boom 4.1, 4.2. This arrangement has the advantage that the individual elements of the main boom 2.1; 2.2 and/or the auxiliary boom 4.1; 4.2 are easier to transport and to handle and the raisable load moment is higher than in a comparable single boom. The top rollers are indicated with 7.1 and 7.2.

Figure 4B:
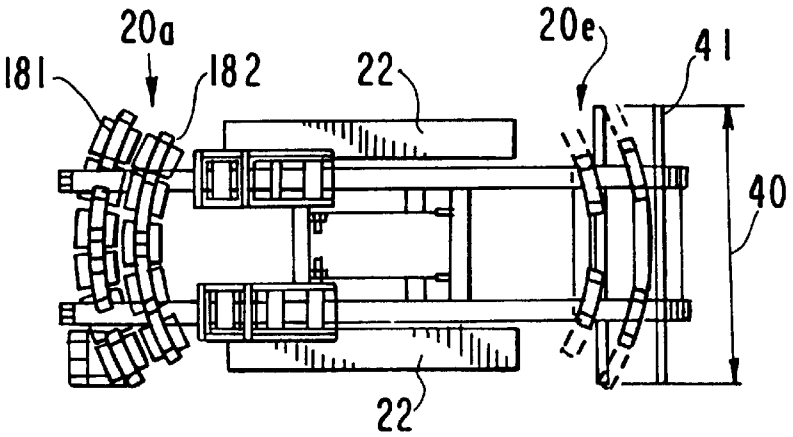
Figure 4A:
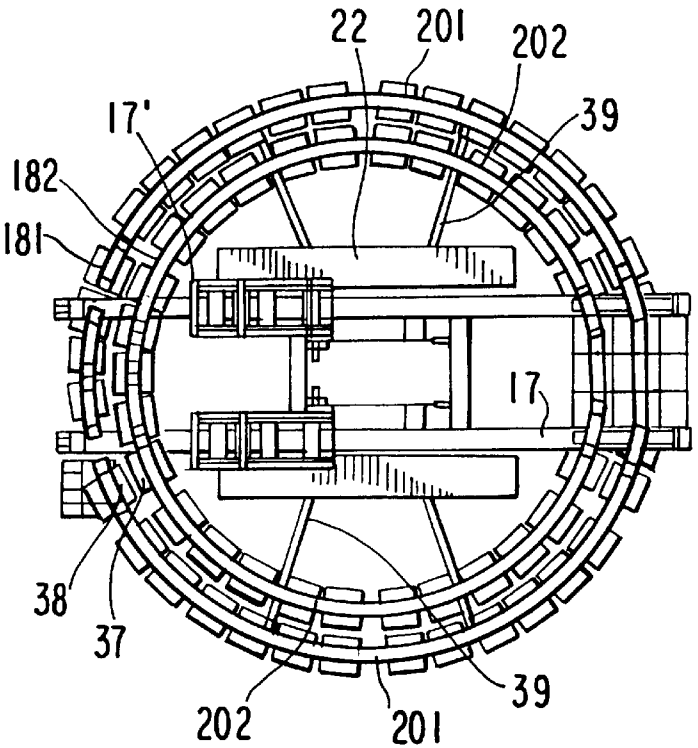
FIGS. 4*a,b* show the dismantling of a number of ring segments.

FIGS. 4 and 5 illustrate the basic operating steps for making the ringlift crane 1 designed according to the invention travel. FIG. 11 deals with this in relation to the locking. Unlike the illustration in FIG. 2, FIGS. 4*a* and 4*b* show the arrangement of a double ring 20.1; 20.2. This arrangement is selected when the raisable load moment is to be increased to a considerable extent, and it is possible in this way for the loads pressing on the ring to be divided in half between two rings 20.1; 20.2. It is indicated roughly in this illustration that the ring trolleys 18.1; 18.2 transmitting the load to the ring are arranged on the two rings 20.1; 20.2. The ring trolleys 18.1; 18.2 are plug-connected to one another via connecting links 37 and bridge elements 38. In order for it to be possible for the double ring 20.1; 20.2 to be centered better in relation to the crawler-type vehicle 22, reinforcing struts 39 are distributed over the circumference between the crawler-type vehicle 22 and double ring 20.1; 20.2.

FIG. 4*b* shows the first basic operating step for making the ringlift crane 1 travel. The segmentation of the ring, which is known per se, is utilized in order for it to be possible to dismantle the segments which disrupt the travel of the ringlift crane 1. Remaining behind are a sub-segment 20*a,* in the region of the main boom 2 and of the mast 3, and an opposite sub-segment 20*e,* in the region of the counterweight 16. The rest of the segments 20*b*–20*d* and 20*f*–20*h* have been dismantled beforehand. The arc length of the sub-segment 20*a,* which is located in the boom region, is selected here such that the ring trolleys 18.1, 18.2 can be accommodated thereon. It is advantageous for the tangential extent of a sub-segment 20*a,* 20*e* to be no larger than the widthwise extent 40 for the counterweight mount 41, with the result that no additional free space is necessary for the travel.

FIGS. 5*a*–5*e* illustrate the rest of the operating steps. In order for it to be possible to raise the ringlift crane 1, there are arranged at the two ends of the two trusses 17, 17' angle pieces 42.1–42.4, on which in each case one piston/cylinder unit 43.1–43.4 can be fastened. The connecting location has a swing-action shoe 47.1–47.4 in order for it to be possible for the longitudinal extent of the ringlift crane 1 to be shortened once the piston/cylinder units 43.1–43.4 have been dismantled. For the purpose of supporting the loads on the ground, all the piston-cylinder units 43.1–43.4 are provided with a large supporting foot 44.1–44.4.

Sub-steps 5*c* and 5*d* illustrate the operating steps for raising the ringlift crane 1. By means of a retaining system (illustrated here in FIG. 6), the sub-segment 20*a* (FIG. 4*b*) of the double ring 20.1; 20.2 is connected to the trusses 17, 17' via the ring trolleys 18.1; 18.2. The same also applies to the opposite sub-segment 20*e*. If the four piston/cylinder units 43.1–43.4 arranged at the ends are then activated, it is then the case, as can be seen in Sub-fIG. 5*d,* that the entire ringlift crane 1 is raised together with the sub-segments 20*a,* 20*e*.

Following the force fitting connection of the trusses 17, 17' to the crossmembers 26, 27 (FIG. 11), the four piston-cylinder units 43.1–43.4 can be raised and the entire ringlift crane 1 can be made to travel in a straight line, either forward or backward. This is shown by a double arrow 45 in Sub-FIG. 5*e*.

Figure 6:
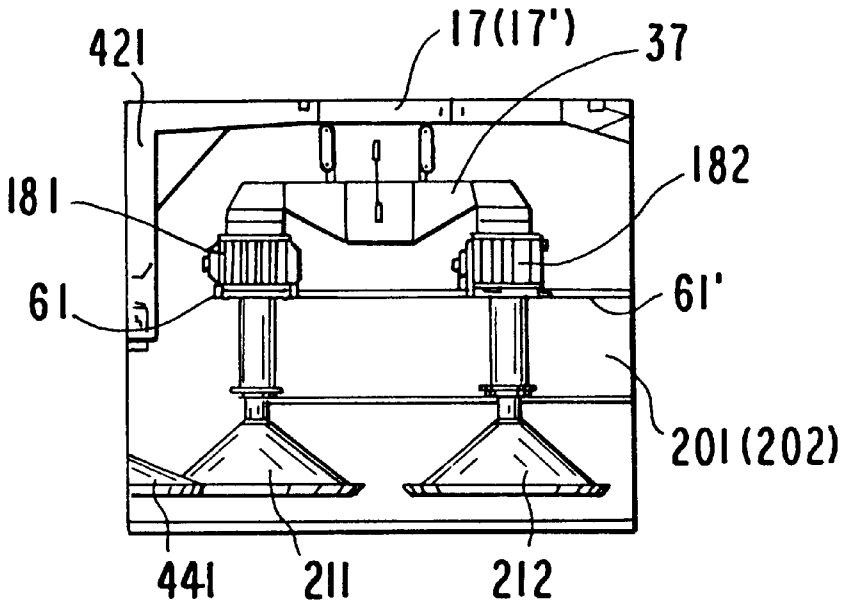
FIG. 6 shows the locking of a ring segment of a double ring to the truss by means of the ring trolleys.

FIG. 6 shows an enlarged illustration of the retaining system for connecting a ring segment 20*a* to the trusses 17, 17'. Articulated, for this purpose, on the ring trolley 18 are supporting plates 61, 61', which, in their end region, are provided with a hook roller 62, 62'. The latter engage beneath the top flange 57 of the respective ring 20.1, 20.2 and thus provide the connection between the ring segment 20*a* and truss 17, 17' (see also FIG. 8*c*).

Figure 5A:
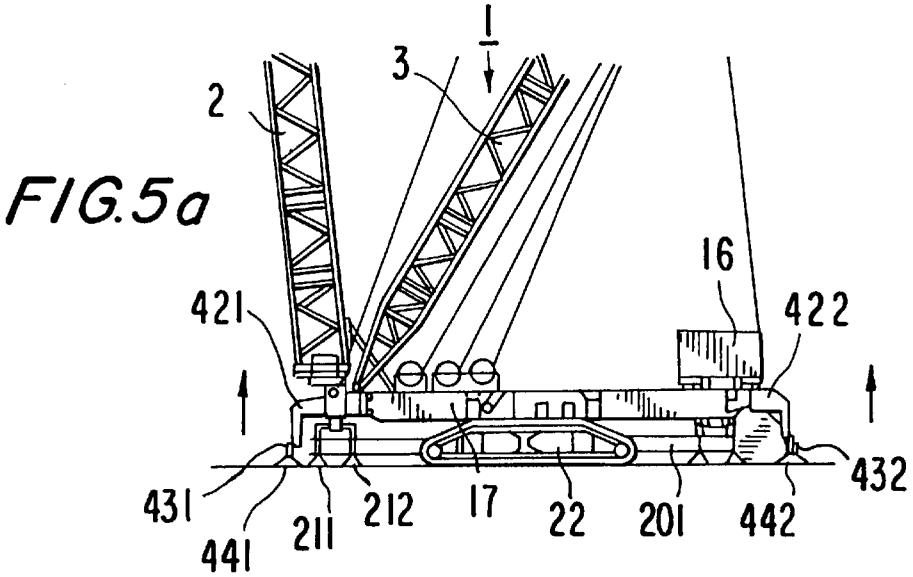
FIGS. 5*a–e* show the raising and traveling operation of the ringlift crane.
Figure 5B:
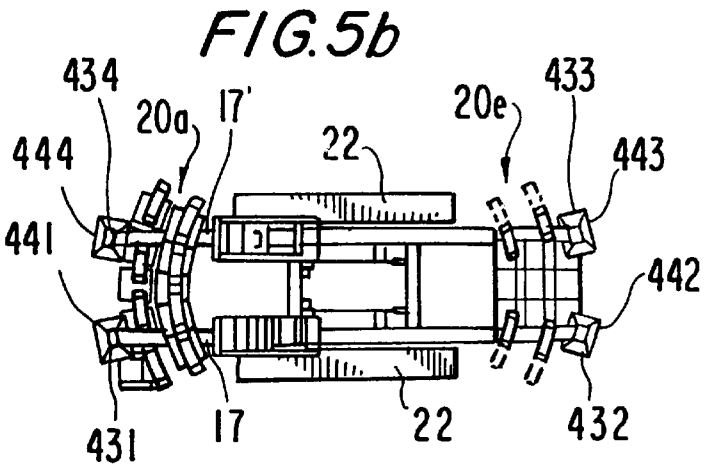
Figure 5C:
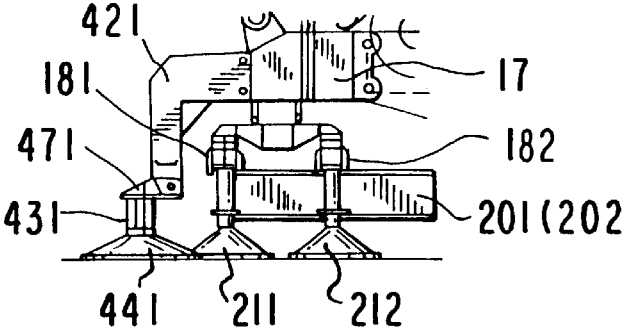
Figure 5D:
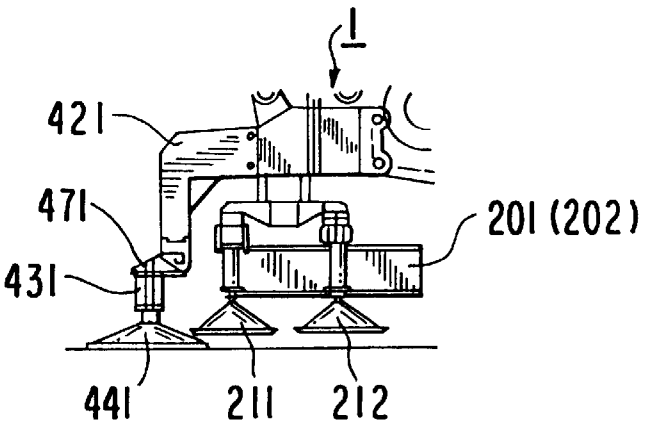
Figure 7:
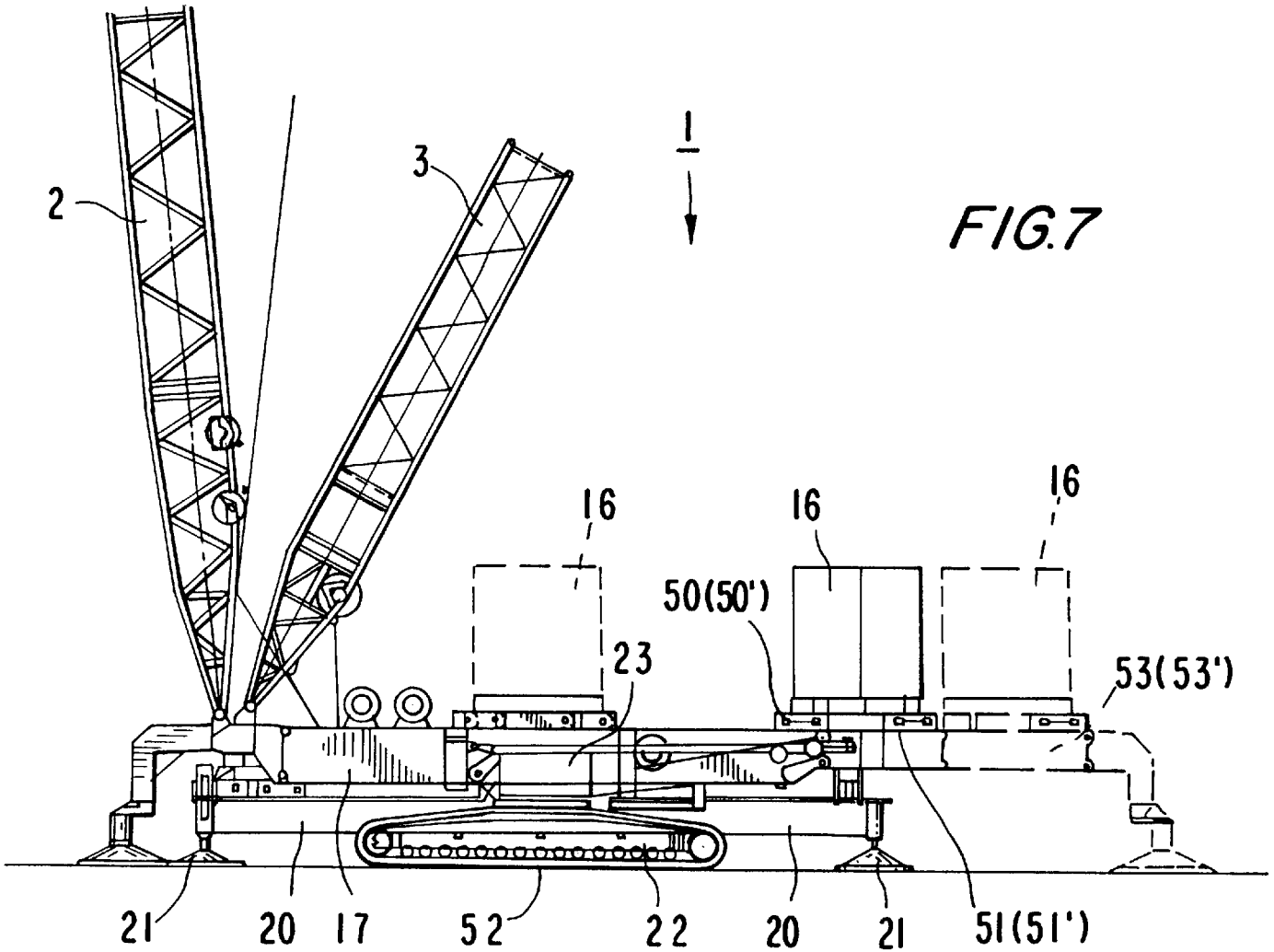
FIG. 7 shows travel positions of the counterweight.

FIG. 7 illustrates the possibility of travel for the counterweight 16. In order for it to be possible for the counterweight 16 to travel, counterweight trolleys 50, 51, 50', 51' are arranged beneath the counterweight 16, it being possible for the rollers of said counterweight trolleys to roll on the top side of the trusses 17, 17'. That position of the counterweight 16 which is marked A constitutes the normal position. If the intention is to make the ringlift crane 1 travel, as explained previously in FIGS. 4 and 5, it is advantageous for the counterweight 16 to be displaced into the region of the slewing axis 52 of the basic machine. This is shown by the position B, which is illustrated by dashed lines. Such a position of the counterweight 16 improves the center-of-gravity position, with the result that the ringlift crane 1 can be made to travel more safely and without the risk of tilting. That position of the counterweight 16 which is marked C shows the possibility of displacing the counterweight 16 outside the ring 20. Arranged, for this purpose, at the end of the two trusses 17, 17' are extensions 53, 53', with the result that the counterweight 16 can be displaced outward by means of the counterweight trolleys 50, 51, 50', 51'. This has the advantage that, with the same load moment, less counterweight 16 is required or, with the same counterweight 16, the load moment can be increased. For the sake of completeness, it should also be pointed out that, as is illustrated in FIG. 5*b,* it is also possible for an angle piece 42.2 or 42.3 to be arranged at the end of such an extension 53 or 53' in order for it to be possible to fasten the piston/cylinder unit 43.2, 43.3.

FIG. 8*a* shows a front view, and FIG. 8*b* shows a plan view, of the details of a ring trolley 18. The ring trolley 18 comprises a frame 48 in which two axles 49, 49' are mounted. The two axles 49, 49' are positioned in relation to the frame 48 at an angle other than a right angle. Ideally, the center lines of the two axles 49, 49' intersect at the slewing center point of the upper carriage. One of the two axles 49' has a stub 54 for the arrangement of a drive (not illustrated here). Fastened on the four corners of the frame 48 are double link plates 55–55''', on which side guide rollers 46–46''' are arranged. The rollers 46–46''' are supported on the side surface of the top flange 57 of the respective ring 20.1, 20.2. Fastened on the axles 49, 49' are in each case two wheels 58, 58', 59, 59', which are supported with rolling action on the top side of the respective ring 20.1, 20.2. The frame 48 is provided, in the center, with a crossmember 60 on which in each case one supporting plate 61, 61' is articulated at both end regions and is provided with a hook roller 62, 62'. The hook rollers 62, 62' are supported on the underside of the top flange 57 of the ring 20.1, 20.2 and limit the raising-up movement of the ring trolley 18. A pin 63 is fastened in the center of the top side of the crossmember 60 with the result that for example two ring trolleys 18.1, 18.2 arranged one behind the other (FIGS. 9*a, b*) can be plugged together. The axles 49, 49' are mounted by bearing elements 66–66''' arranged in the frame 48.

Figure 8C:
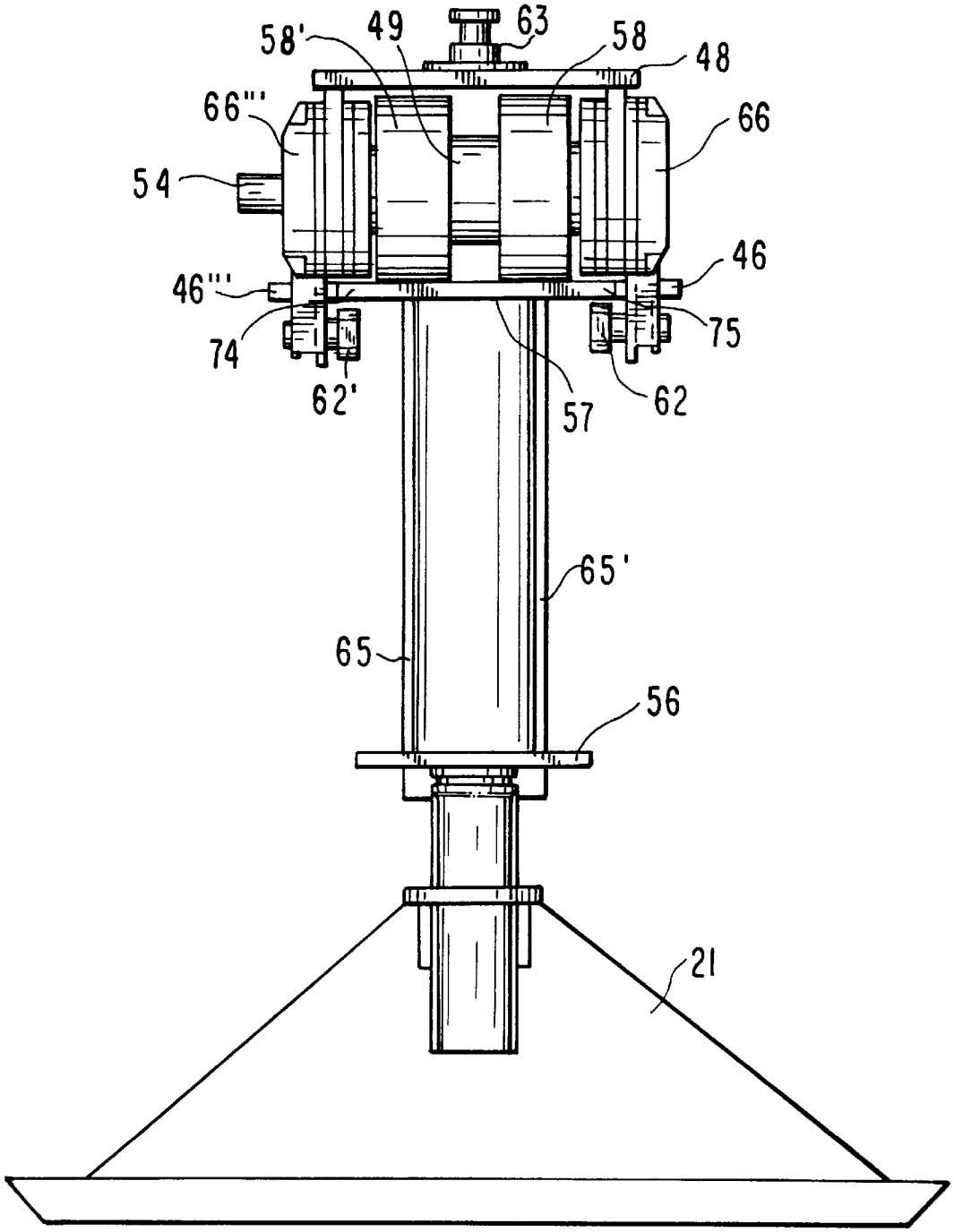
FIG. 8*c* shows a view in the direction X in FIG. 8*a;* including a support.

FIG. 8*c* shows, in a view in the direction X in FIG. 8*a,* the use of the ring trolleys 18 as a connecting element between the rings 20.1, 20.2 or ring segments 20*a,* 20*e* (see FIG. 5*b*) and the trusses 17, 17'. This view clearly shows the hook rollers 62, 62' gripping beneath the top flange 57 of the ring. The ring trolley is supported laterally via the side guide rollers 46, 46'''. The ring, which forms an annular track, comprises the above-mentioned top flange 57 and a bottom flange 56 and webs 65, 65' connecting the two. The ring can be elevated via the supports 21 which can be fastened in a vertically adjustable manner on the bottom flange 56. This compensates for unevennesses of the ground.

It cannot be seen from the illustration in FIG. 8*c* that the two wheels 58, 58' arranged on each axle 49 are of different diameters. This is necessary in order to compensate for the different rolling paths. The wheel 58', which rolls on the inner region of the top flange 57, is smaller in diameter than the wheel 58, which rolls on the outer region. In order that the axle 49 remains horizontal, despite the different diameters of the two wheels 58, 58', the top flange 57 is divided up into an inner track 74 and an outer track 75. Located therebetween is a step, of which the height corresponds to half the difference between the wheel diameters. This means that the outer track 75 is located at a lower level than the inner track 74. With an assumed difference between the wheel diameters of 20 mm, the height of the step is thus 10 mm. Despite being divided up into an inner track 74 and an outer track 75, the top flange 57 is produced from a metal sheet and the lower-level, outer track 75 is produced by mechanical working (e.g. milling).

Figure 9A:
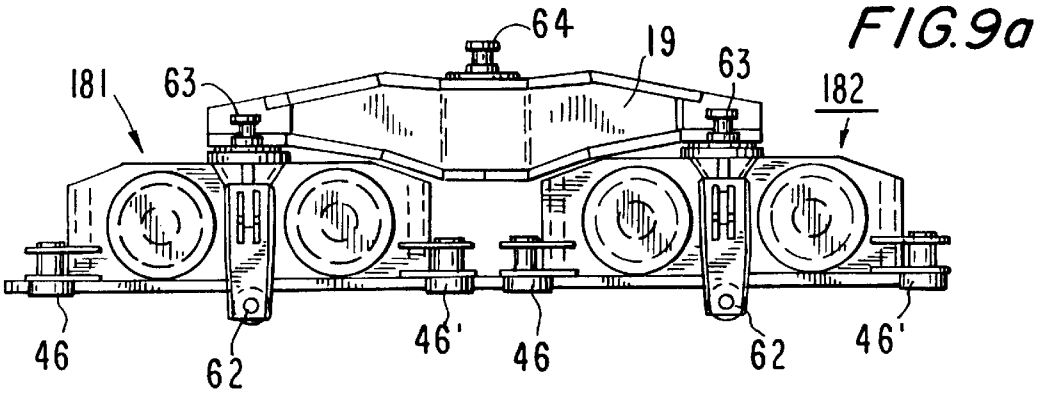
FIGS. 9*a,b* show the connection of two ring trolleys.
Figure 9B:
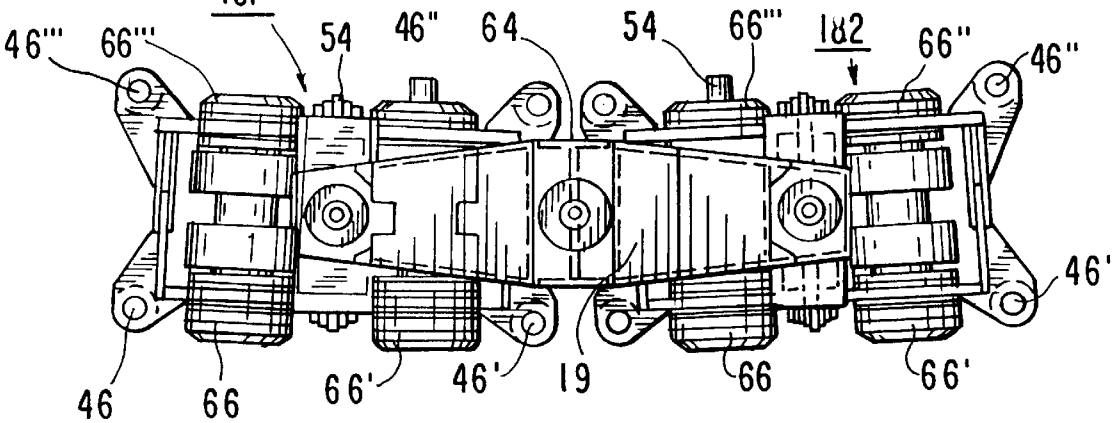

FIGS. 9*a, b* illustrate a front view and a plan view of the case where two plugged-together ring trolleys 18.1, 18.2 are arranged one behind the other, and the same designations have been used for the same parts as in the illustration in FIGS. 8*a, b*. As can be seen from the illustration, the two ring trolleys 18.1, 18.2 are of identical construction. In order for it to be possible for the two ring trolleys 18.1, 18.2 to be connected to one another, a basic link 19 is positioned on the two pins 63 of the respective ring trolley 18.1, 18.2. The basic link 19 is likewise provided with a pin 64 in the center. the pin 64 serves for connecting to one another, by means of a connecting link 37 (not illustrated here), ring trolleys 18 on two concentric rings 20.1, 20.2 (see FIG. 4*a*).

Figure 10A:
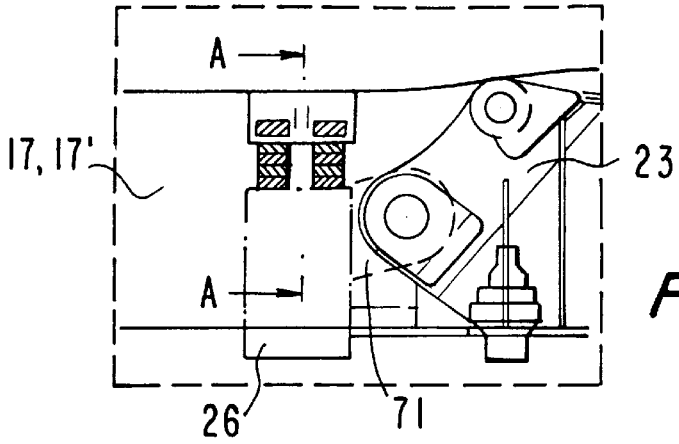
FIGS. 10*a–d* show the pivot-locking sequence.

FIGS. 10*a–d* illustrate the basic steps for a pivot-locking sequence. FIG. 10*a* shows the connection of the crossmembers 26, 27 to a sub-element of the upper carriage 23. Fastened, for this purpose, on the respective crossmember 26, 27 is a link plate 71 which can be bolted to, and unbolted from, the sub-element of the upper carriage 23.

Figure 10B:
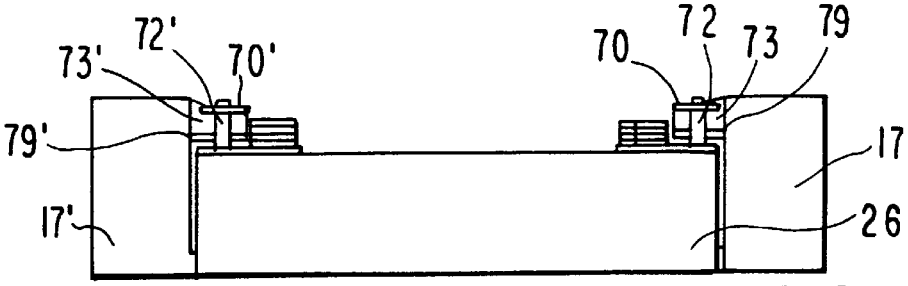
Figure 10C:
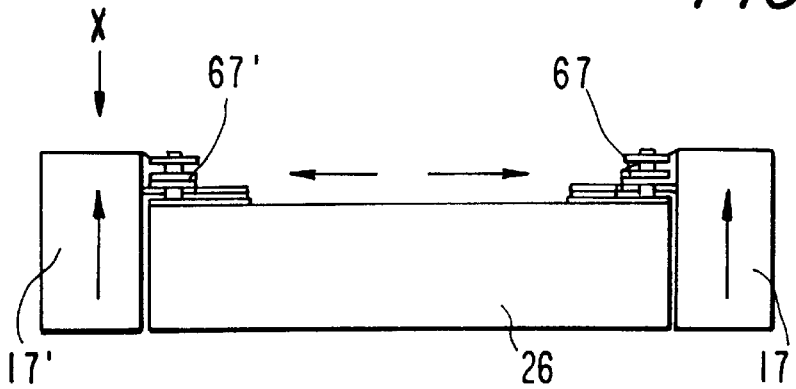
Figure 10D:
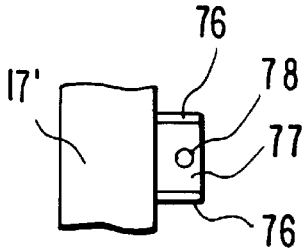

The FIG. 10*b* illustrates the section A—A from FIG. 10*a*. It shows the two trusses 17, 17' arranged on the right and left and the front crossmember 26 located therebetween (FIG. 2). Arranged on the top side of each crossmember 26, 27, in the two end regions, is in each case one upright bolt 72, 72'. A stop, in this case in the form of a round plate 70, 70', is fastened on the end side of the bolt 72, 72'. The respective bolt 72, 72' interacts with a bearing block 73, 73' fastened on the truss 17, 17'. The bearing block 73, 73' is constructed as a U-shaped box with two side pieces 76 and a base plate 77 located therebetween. The base plate 77 has an opening 78 through which the bolt 72, 72' can be plugged (FIG. 10*d*). In the starting position, a level of play 79, 79', which can be seen clearly here, is provided between the underside of the base plate 77 and the top side of the crossmember 26, 27. For the purpose of setting the different locking states, a plurality of spacer plates 67, 67' which can be displaced in the direction of the bolts 72, 72' are arranged on the top side of the crossmember 26, 27. Displacement takes place along guide rails 68, 68' (FIGS. 11*b, c*). The means for displacing the spacer plates 67, 67' are not illustrated here. A hydraulic piston/cylinder unit is preferably used for this purpose.

The pivot-locking sequence contains the following individual steps: some, for example two, of the spacer plates 67, 67' are displaced along the guide rails 68, 68', in the direction of the bolts 72, 72', by means of a piston/cylinder unit (not illustrated here). This partially fills the spacing between the top side of the base plate 77 of the bearing block 73, 73' and the underside of the plate 70, 70' of the bolt 72, 72'. Thereafter, the two trusses 17, 17' are raised by means of the four piston/cylinder units 43.1–43.4 (FIG. 5*b*), as the two depicted arrows show. As the two trusses 17, 17' are raised, the remaining spacing is eliminated, with the result that the pushed-in spacer plates 67, 67' come into abutment with a force fit between the base plate 77 of the bearing block 73, 73' and the plate 70, 70' of the bolt 72, 72'. Via this force fitting connection, the crossmembers 26, 27 are raised upward as well, as are thus also, in accordance with the connection illustrated in FIG. 10*a*, the upper carriage 23 and the undercarriage, which is fastened thereon. At the same time, via the connection between ring trolleys 18 and the trusses 17, 17', the ring is likewise raised upward. In this state, the slewing gear of the upper carriage 23 is activated and, with the upper carriage stationary, the ring is pivoted into the desired position together with the undercarriage (crawler-type vehicle). Thereafter, air is extracted from the four piston/cylinder units 43.1–43.4 and the trusses 17, 17' are thus lowered again. As soon a sufficient spacing has been established between the base plate 77 and the plate 70, 70', the pushed-in spacer plates 67, 67' can be drawn out again along the guide rails 68, 68' and bolted to the rest of the spacer plates by means of carry-along pins 69, 69' (FIG. 11).

Figure 5E:
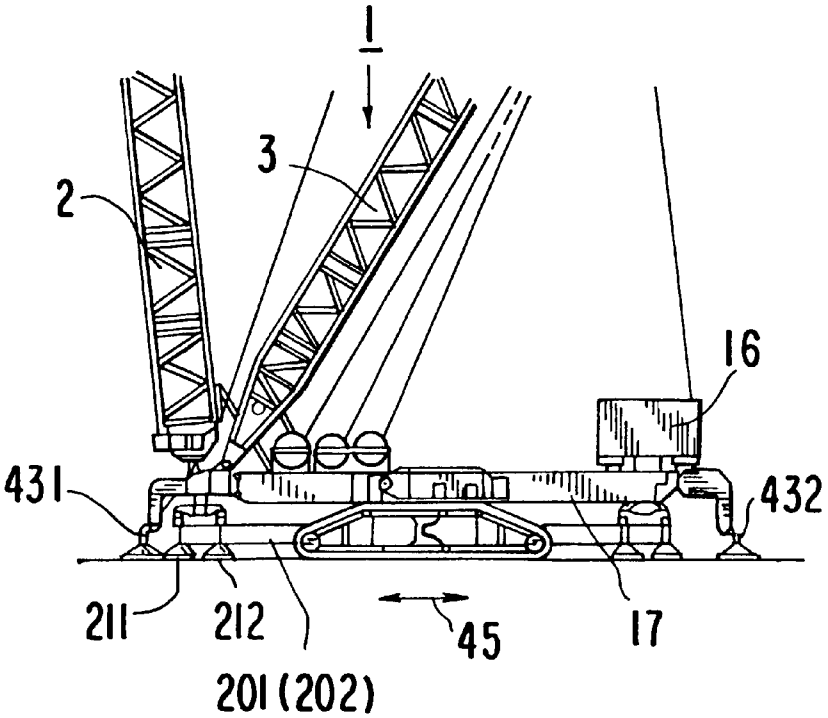
Figure 11A:
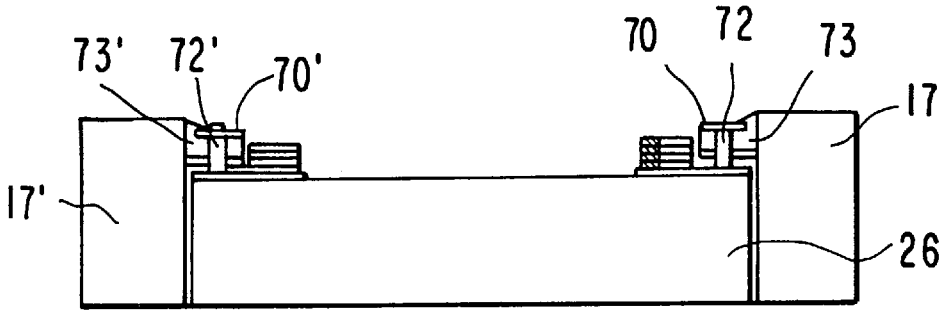
FIGS. 11*a–d* show the travel-locking sequence.
Figure 11B:
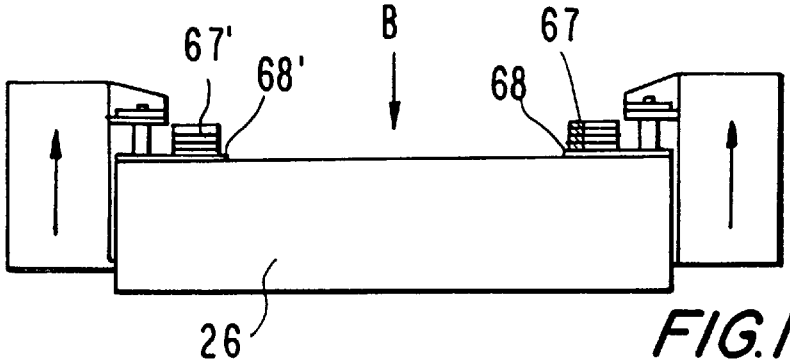
Figure 11C:
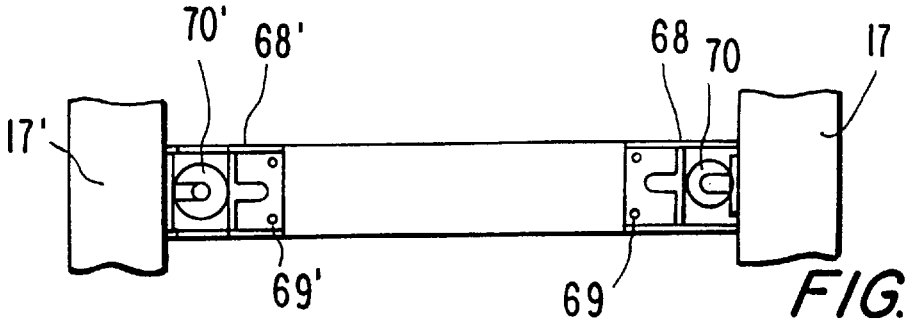
Figure 11D:
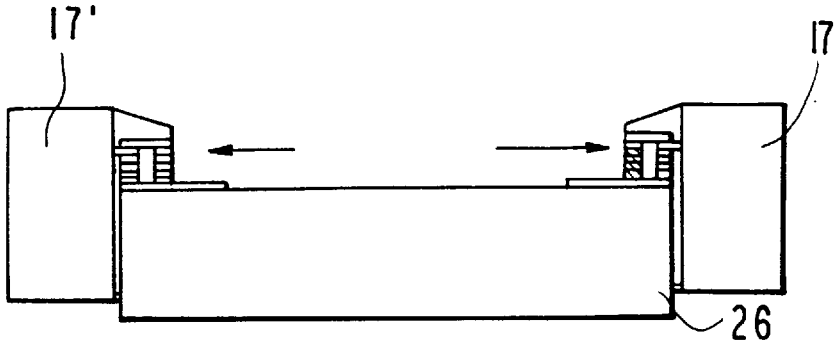

FIGS. 11*a–d* illustrate the travel-locking sequence. FIG. 11*a* shows the starting position, as has already been described in FIG. 10*b*. FIG. 11*b* shows the first operating step. In this case, the trusses 17, 17' have been raised upward by means of the four piston/cylinder units 43.1–43.4 to such an extent, e.g. by 500 mm, that the top side of the base plate 77 of the bearing block 73, 73' comes into abutment against the underside of the plate 70, 70'. In this way, space has been made in order for it to be possible for the entire assembly of spacer plates 67, 67' to be pushed in, as is illustrated in FIG. 11*d*. Once air has been extracted from the four piston/cylinder units 43.1–43.4, the two trusses 17, 17' are lowered, with the result that a force fitting connection is formed between the trusses 17, 17' and crossmembers 26, 27 via the pushed-in spacer plates 67, 67'. By virtue of the two trusses 17, 17' being forced upward, at the same time the entire ring or the ring segments 20*a–*20*e* located in the adapter region (FIG. 4*b*) are raised as well. As FIG. 5*e* shows, the four piston/cylinder units 43.1–43.4, relieved of loading, can be drawn in and the ringlift crane can be moved in a straight line, forward or backward.

Figure 12A:
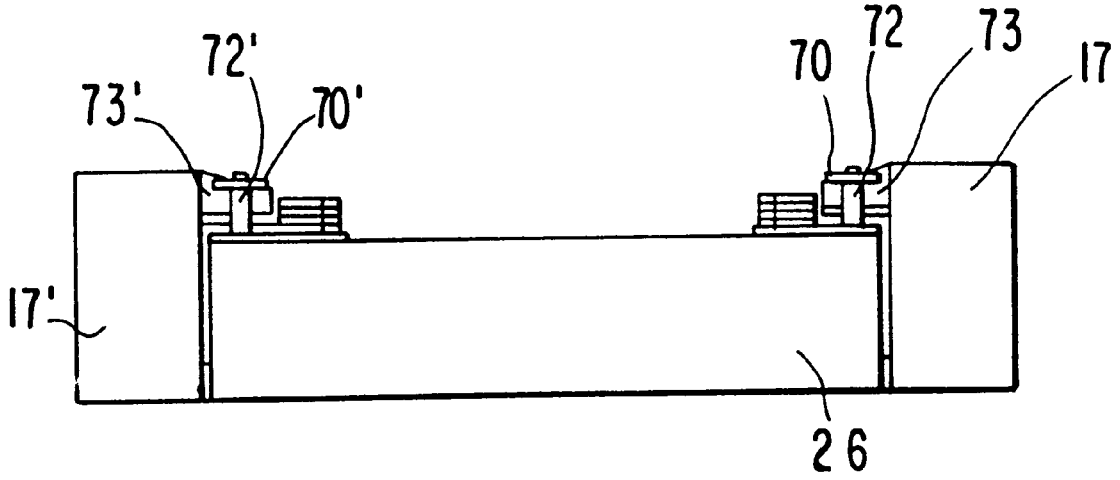
FIGS. 12*a,b* show the operational-locking sequence.
Figure 12B:
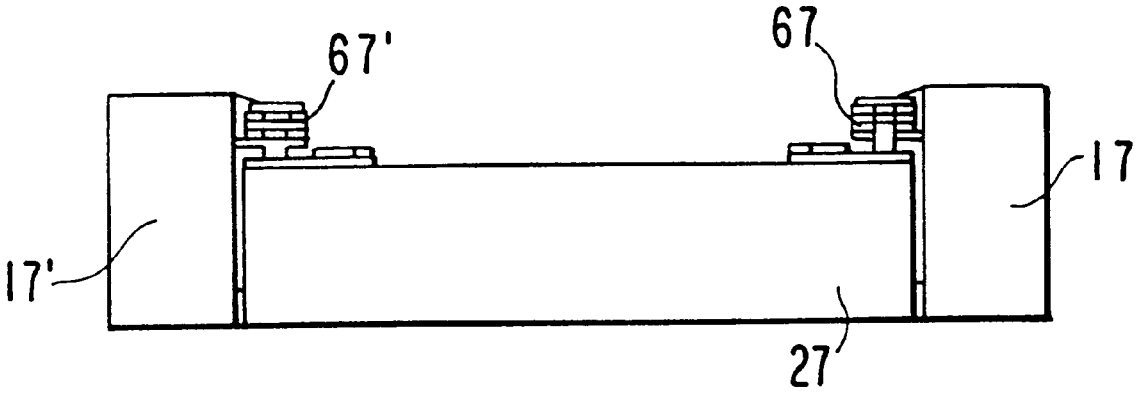

FIG. 12 shows the operational locking. In this case, it is sought to utilize simultaneously, as far as possible, some of the dead weight of the crane for the purpose of increasing the overall stability. This is achieved in that, in the starting position, similarly to the case illustrated in FIG. 10*c*, some of the spacer plates 67, 67' are pushed in only at the rear crossmember 27. This largely fills the spacing between the base plate 77 and plate 70, 70'. If a load is then suspended from the hook of the ringlift crane, the entire ringlift crane then bends elastically such that at the front, i.e. in the region of the boom, the loads press on the underlying surface, i.e. the adapter 24, ring segment 20*a*, supports 21, while the rear part of the trusses 17, 17' is bent upward. During the bending-upward movement, the remaining space between the base plate 77 and plate 70, 70' is eliminated and a force fitting connection is produced between the truss 17, 17' and the rear crossmember 27. Since the crossmember 27, in turn, is connected to the upper carriage 23, some of the dead weight of the crane is utilized by said force fitting connection for the purpose of increasing the overall stability.

The invention is not limited by the embodiments described above which are presented as examples only but can be modified in various ways within the scope of protection defined by the appended patent claims.

What is claimed is:

1. A ringlift crane, comprising: a ring which can be elevated, forms an annular track and has a plurality of segments which can be connected to one another; means for elevating the ring; means for connecting the segments to one another; an undercarriage arranged within said ring, the undercarriage having an upper carriage which is connected for stewing action to the undercarriage and has a plurality of hoisting winches; two trusses which are spaced apart and parallel to one another and have two mutually opposite end regions; two adapters, a respective one of the adapters extending between the trusses in each end region; cross members provided so that the trusses are releasably connected to the upper carriage; rollers arranged in an end region of the adapters so as to support the adapters with rolling action on the annular track of the ring, a center point of at least one of the ring and the undercarriage forming a slewing axis; a counterweight; a boom, one of the adapters being configured to accommodate the counterweight and another of the adapters being configured to accommodate the boom; means for producing a slewing movement of the upper carriage; reinforcing struts arranged to connect the undercarriage to different sections of the ring, the trusses being raisable and connectable in different manners to the crossmembers with a force fit for purposes of setting different modes of operation of the crane in a starting position, the form-fitting connection between the trusses and the crossmembers having a predeterminable level of play; and a plurality of ring trolleys provided for the slewing movement of the upper carriage, the ring trolleys being of identical construction having two axles and wheels fastened thereon, the ring trolleys being connected with a form fit to the trusses and to one of the ring and a ring segment.

2. A ringlift crane as defined in claim 1, and further comprising an upright bolt arranged on each crossmember on a top side of a respective end region, the upright bolt having a free end with a stop that interacts with a bearing block arranged on the truss so as to engage around the bolt, and still further comprising spacer plates, which can be displaced in a direction of the bolts, arranged on the top side of each crossmember so as to at least partially fill a space between the top side of the crossmember and the stop of the respective bolt, and a space between the bearing block and the stop of the bolt.

3. A ringlift crane as defined in claim 2, wherein the bearing block has a box configuration with two spaced-apart side pieces and a base plate which is located therebetween and has an opening for the through-passage of the bolt.

4. A ringlift crane as defined in claim 2, wherein the stop of the bolt is a round plate which is connectable to the bolt.

5. A ringlift crane as defined in claim 2, wherein the respective spacer plate has a cutout for enclosing the bolt and is provided with at least one opening which is in alignment with other of the spacer plates and is configured to accommodate a carry-along pin.

6. A ringlift crane as defined in claim 1, wherein the ring includes two concentric rings which each have an annular track, the boom including a main boom and a mast, the counterweight and the boom being supported on the concentric rings via the ring trolleys, the ring trolleys which are located behind one another on each annular track being connected to one another by a basic link, and mutually opposite ring trolleys being connected to one another by a connecting link.

7. A ringlift crane as defined in claim 6, wherein two ring trolleys arranged on the inner ring and two ring trolleys arranged on the outer ring form a unit, this unit and a further unit of similar configuration being connected together by a bridge element.

8. A ringlift crane as defined in claim 7, wherein connection of the ring trolley, the basic link, the connecting link and the bridge element is a plug-in connection.

9. A ringlift crane as defined in claim 6, wherein a maximum number of ring trolleys which can be arranged on a ring is no greater that an arc length of the individual ring segment divided by a length of the ring trolleys.

10. A ringlift crane as defined in claim 9, wherein an angle taken up by a ring segment is 60 degrees.

11. A ringlift crane as defined in claim 6, wherein there is an even number of segments of each ring, of which segments two mutually opposite segments are connected to the trusses via the ring trolleys.

12. A ringlift crane as defined in claim 11, wherein a tangential extent of the segments which can be locked to the trusses is no greater than the widthwise extent of the counterweight.

13. A ringlift crane as defined in claim 6, wherein two intersecting center lines of the two axles of each ring trolley enclose an angle which corresponds to an average of the angles produced for a ring with a smallest diameter and for a ring with a largest diameter.

14. A ringlift crane as defined in claim 13, wherein a wheel of each ring trolley which rolls on an outer region of the respective ring, has a larger diameter than a wheel which rolls on an inner region of the ring.

15. A ringlift crane as defined in claim 14, wherein each ring includes a top flange subdivided into an outer track and an inner track separated by a parting plane with a step having a height that corresponds to half of a difference between the two diameters of the wheels.

16. A ringlift crane as defined in claim 15, wherein each ring trolley has a frame on both sides of which frame one supporting plate is provided that has a hook roller that engages beneath the top flange of the ring.

17. A ringlift crane as defined in claim 1, and further comprising a piston/cylinder unit arranged in end regions of each truss so that the truss is raisable, a supporting foot being connected to a free end of the piston.

18. A ringlift crane as defined in claim 17, and further comprising an angle piece fastened on each end side of each truss, each angle piece having a free end connectable to the piston/cylinder unit.

19. A ringlift crane as defined in claim 1, and further comprising counterweight trolleys arranged beneath the counterweight, the counterweight trolleys having wheels that roll on a top side of the two trusses.

20. A ringlift crane as defined in claim 19, and further comprising an extension arranged at that end of the two trusses which is located in a region of the counterweight so that said extension extends beyond the ring.

21. A ringlift crane as defined in claim 20, and further comprising a piston/cylinder unit arranged at an end of the extension so that the trusses are raisable, a supporting foot being connected to a free end of the piston.

* * * * *